United States Patent [19]

Aoyama

[11] 4,180,033

[45] Dec. 25, 1979

[54] EXHAUST GAS RECIRCULATION CONTROL SYSTEM

[75] Inventor: Syunichi Aoyama, Yokohama, Japan

[73] Assignee: Nissan Motor Company, Limited, Japan

[21] Appl. No.: 830,343

[22] Filed: Sep. 2, 1977

[30] Foreign Application Priority Data

Sep. 3, 1976 [JP] Japan ..... 51-105972

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,834,366 | 9/1974 | Kingsbury | 123/119 A |
| 3,844,260 | 10/1974 | Scott et al. | 123/119 |
| 3,880,129 | 4/1975 | Hollis, Jr. | 123/119 A |
| 3,896,777 | 7/1975 | Masaki et al. | 123/119 A |
| 4,050,429 | 9/1977 | Yasuhiro et al. | 123/119 A |

*Primary Examiner*—Wendell E. Burns

*Attorney, Agent, or Firm*—Robert E. Burns; Emmanuel J. Lobato; Bruce L. Adams

[57] ABSTRACT

An altitude correction device is provided which adjusts a working vacuum, in the diaphragm unit for operating the EGR control valve, in accordance with the atmospheric pressure so as to reduce the flow of recirculated engine exhaust gases in accordance with decrease in the atmospheric pressure to maintain the EGR amount at a proper value independent of the altitude.

9 Claims, 3 Drawing Figures

EXHAUST GAS RECIRCULATION CONTROL SYSTEM

BACKGROUND OF THE INVENTION

1. Field of the Invention

The present invention relates generally to an exhaust gas recirculation system for an internal combustion engine of a vehicle which system is provided with an altitude correction device.

2. Description of the Prior Art

As is well known in the art, an internal combustion engine is provided with an exhaust gas recirculation (EGR) system for recirculating exhaust gases of the engine into air taken thereinto to reduce the amount of nitrogen oxides (NOx) produced by combustion in the engine.

Since the exhaust gases fed into the engine taken air are considered to be inert gas which serves to limit combustion temperature in the engine, when a proper quantity of exhaust gases are recirculated, the recirculated exhaust gases are extremely effective for reduction in the production of nitrogen oxides. However, when an excessive quantity of exhaust gases are recirculated, the recirculated exhaust gases exert a bad influence on the combustion in the engine or the stability of operation of the engine.

As an example of the cases in which the recirculated exhaust gases have a bad influence on the operation of an engine, the case is considered in which the engine is running on a land having a high altitude.

Since as the altitude is increased, the atmospheric pressure is reduced to reduce the density of air, the amount of oxygen fed into the engine is reduced to cause change or decrease in the air-fuel ratio set for the operation of the engine on a land having a low altitude. Thus, as is well known in the art, the fuel supply system of an engine is provided with an altitude correction device for reducing the amount of fuel fed into the engine to a proper value in accordance with increase in the altitude to correct the air-fuel ratio of the engine to a predetermined desired value.

However, a conventional EGR control system has not been provided with an altitude connection device for reducing the amount of exhaust gases recirculated into the engine taken air when the altitude is increased. As a result, the conventional EGR control system has undergone inconveniences that an EGR ratio of the flow of recirculated exhaust gases to the flow of engine taken air is excessively increased to exert on the stability of operation of the engine a bad influence such as, for example, stopping the operation of the engine when the engine is running on a land having a high altitude.

SUMMARY OF THE INVENTION

It is, therefore, an object of the invention to provide an EGR control system which is capable of recirculating a proper quantity of engine exhaust gases into engine taken air independently of the altitude.

This object is accomplished by providing first means for causing change in a working pressure such as, for example, an engine suction vacuum or a venturi vacuum which determines the degree of opening of the EGR control valve and second means operated by a bellows changing its volume in response to change in the atmospheric pressure, and by having the second means control the first means so that the working pressure causes the EGR control valve to reduce the flow of recirculated engine exhaust gases in accordance with decrease in the atmospheric pressure.

BRIEF DESCRIPTION OF THE DRAWINGS

This and other features and advantages of the invention will become more apparent from the following detailed description taken in connection with the accompanying drawings in which.

DESCRIPTION OF THE SPECIFIC EMBODIMENTS

Figure 1:
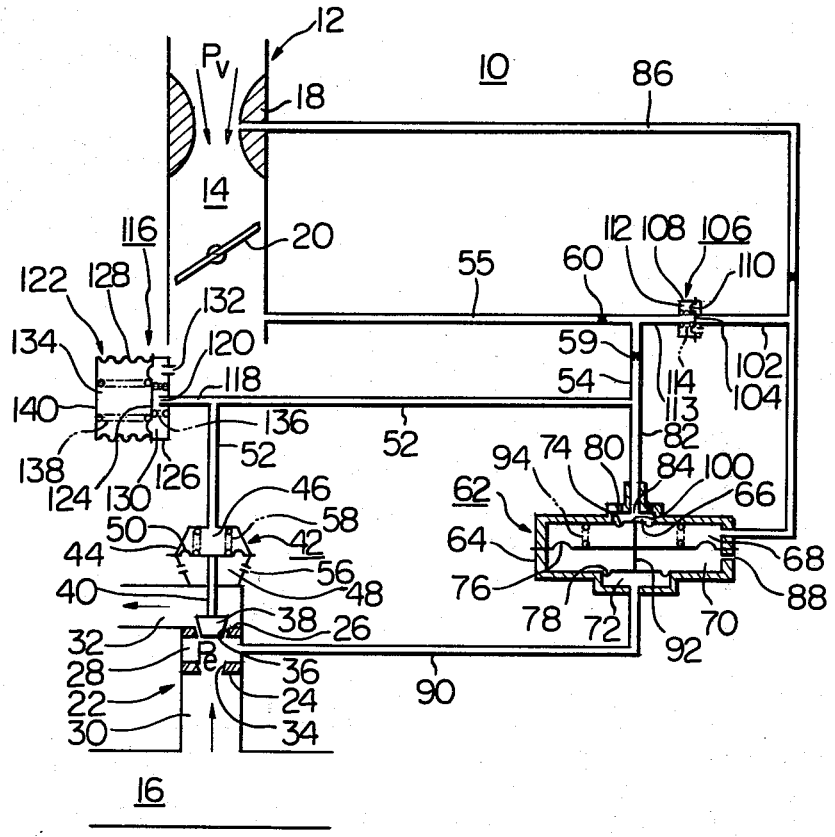
FIG. 1 is a schematic view of a first preferred embodiment of an exhaust gas recirculation (EGR) control system according to the invention.

Referring to FIG. 1 of the drawings, there is shown an exhaust gas recirculation (EGR) control system according to the invention. The EGR control system, generally designated by the reference numeral 10, is combined with an internal combustion engine of a motor vehicle. The engine includes a carburetor 12, an intake passageway 14 passing through the carburetor 12 and providing communication between the atmosphere and the engine for conducting air thereinto, and an exhaust gas passageway 16 providing communication between the engine and the atmosphere for conducting thereto exhaust gases emitted from the engine. The intake passageway 14 has a venturi 18 formed therein and a throttle valve 20 rotatably mounted in the intake passageway 14 downstream of the venturi 18. The EGR control system 10 comprises an EGR passageway 22 providing communication between the exhaust gas passageway 16 and the intake passageway 14 downstream of the throttle valve 20 for recirculating or conducting the engine exhaust gases into the intake passageway 14. The EGR passageway 22 is formed therein with partition members 24 and 26 which divide the EGR passageway 22 into a chamber 28 defined between the partition members 24 and 26 and upstream and downstream parts 30 and 32 located respectively upstream and downstream of the chamber 28. The partition member 24 is formed therethrough with an orifice 34 which provides communication between the upstream part 30 and the chamber 28 to form a restriction of the EGR passageway 22 which controls the flow of recirculated engine exhaust gases. The partition member 26 is formed therethrough with an aperture or passage 36 which provides communication between the chamber 28 and the downstream part 32.

An EGR control valve 38 is disposed in the EGR passageway 22 movably relative to the aperture 36 to control the effective cross sectional area thereof. The EGR control valve 38 includes a valve stem 40 extending therefrom externally of the EGR passageway 22, and a diaphragm unit 42 for operating the EGR control valve 38. The diaphragm unit 42 comprises a housing 44 having first and second chambers 46 and 48, and a flexible diaphragm 50 isolating the chambers 46 and 48 from each other. The chamber 46 communicates with the intake passageway 14 downstream of the throttle valve 20 through passages or conduits 52, 54 and 55 to receive an engine suction vacuum, while the chamber 48 communicates with the atmosphere through an opening 56. The diaphragm 50 is operatively connected to the EGR control valve 38 through the valve stem 40 so that the EGR control valve 38 increases and reduces the effective cross sectional area of the aperture 36 to reduce and increase the pressure $P_e$ in the chamber 28 in accordance with increases and decreases in the working vacuum in the chamber 46, respectively. A spring 58 is provided to urge the diaphragm 50 in a direction opposed by the atmospheric pressure in the chamber 48. The passages 54 and 55 are formed therein with orifices 59 and 60, respectively.

A vacuum signal adjusting device 62 is provided which controls the vacuum in the chamber 46 and therefore the degree of opening of the EGR control valve 38 in accordance with a venturi vacuum Pv in the venturi section 18 so that the pressure Pe in the chamber 28 is reduced in accordance with an increase in the venturi vacuum Pv. Also, the feedback of the pressure Pe to the vacuum signal adjusting device 62 is performed for revising the control vacuum for the EGR control valve 38 so that the pressure Pe in the chamber 28 is prevented from being varied by the pressure in the downstream part 32 influenced by the engine suction vacuum.

The vacuum signal adjusting device 62 comprises a housing 64 having therein four chambers 66, 68, 70 and 72, and three flexible diaphragms 74, 76 and 78. The diaphragm 74 isolates the chambers 66 and 68 from each other. The diaphragm 76 isolates the chambers 68 and 70 from each other. The diaphragm 78 isolates the chambers 70 and 72 from each other. The chamber 66 communicates with the atmosphere through an opening 80 and with the passages 52 and 54 through a passage or conduit 82 and a port or open end 84. The chamber 68 communicates with the venturi section 18 through a passage or conduit 86 to receive the venturi vacuum. The chamber 70 communicates with the atmosphere through an opening 88. The chamber 72 communicates with the chamber 28 of the EGR passageway 22 through a passage or conduit 90 for performing the feedback of the pressure Pe in the chamber 28 into the chamber 72 to revise the control vacuum in the chamber 46. The diaphragms 74, 76 and 78 are fixedly connected to each other by a rod 92 so that they are operated integral with each other. A spring 94 is provided to urge the integral diaphragms 74, 76 and 78 in a direction opposed by the atmospheric pressure in the chamber 70. A control valve 100 is fixedly secured to the diaphragm 74 in the chamber 66 to control the degree of opening of the port 84 to the chamber 66 and therefore the flow of atmospheric air fed from the chamber 66 into the passage 82.

A relief passage or conduit 102 is branched off from the passage 86 and has an open end 104 providing communication between the passage 102 and the atmosphere. Leak valve means 106 is disposed for opening and closing the open end 104 of the passage 102. The leak valve means 106 includes a housing 108 and a flexible diaphragm 110 defining a vacuum chamber 112 in the housing 108. The vacuum chamber 112 communicates with both the passages 54 and 55 through a passage or conduit 113 to receive the suction vacuum from the intake passageway 14 through the orifice 60 and the control vacuum from the chamber 46 through the orifice 59. The diaphragm 110 serves as a leak valve which opens and closes the open end 104 or the diaphragm 110 has such a valve fixedly connected thereto. The diaphragm 110 or the diaphragm 110 and the leak valve are moved toward and away from the open end 104 of the passageway 102 in response to a decrease and an increase in the vacuum in the chamber 112. A spring 114 is provided to urge the diaphragm 110 and the leak valve toward the open end 104. The diaphragm 110 is held by the force of the spring 114 in a closed position in which the leak valve closes the open end 104 when the vacuum in the chamber 112 is below a predetermined value.

An altitude correction device 116 is provided which serves to have the EGR control system 10 maintain the amount of recirculated exhaust gases at a proper value when the altitude is varied. The altitude correction device 116 comprises a relief passage or conduit 118 which is branched off from the passage 52 and which has an open end 120 providing communication between the passage 118 and the atmosphere, and altitude correction valve means 122 for opening and closing the open end 120 of the passage 118. The altitude correction valve means 122 comprises a flexible diaphragm 124, a housing 126 to which the diaphragm 124 is fixed, and a bellows 128 fixedly secured at one end portion to the diaphragm 124 stationarily relative to the open end 120 and located at the other end portion 140 movably relative to the open end 120. The diaphragm 124 defines in the housing 126 an atmospheric chamber 130 communicating with the atmosphere through an opening 132 and receiving the open end 120 and defines in the bellows 128 together therewith a chamber 134. The diaphragm 124 serves as a valve which opens and closes the open end 120 of the passage 118 or the diaphragm 124 has such a valve fixedly secured to the diaphragm 124. Springs 136 and 138 are located respectively in the chambers 130 and 134. The spring 136 urges the diaphragm 124 or the diaphragm 124 and the valve away from the open end 120 of the passage 118. The spring 138 urges the diaphragm 124 and the end wall portion 140 of the bellows 128 away from each other to lengthen the bellows 128.

The chamber 134 is hermetically sealed from the outside of the bellows 128 to form an air-tight chamber and is filled with atmospheric air admitted thereinto on a land on which the engine is usually running and which has a relatively low altitude at which the atmospheric pressure is, for example, about 1 atmosphere. Alternatively, the chamber 134 may be filled with other gas serving similarly to the atmospheric air in lieu thereof. The force of each of the springs 136 and 138 is selected so that, when the atmospheric pressure in the outside of the air-tight chamber 134 is, for example, about 1 atmosphere, the diaphragm 124 or the valve is located in a closed position in which it closes the open end 120 of the passage 118.

The EGR control system 10 thus described is operated as follows:

When the engine is running on a land having a normal altitude at which the atmospheric pressure is about 1 atmosphere, since the open end 120 of the passage 118 is closed by the diaphragm 124 or the valve, the EGR control system 10 is operated in a condition in which the altitude correction device 116 is inoperative or rest in the following manner.

When a venturi vacuum Pv is produced in the venturi section 18 by the flow of air drawn into the engine through the intake passageway 14 and the venturi vacuum Pv is increased by increase in the air flow, the diaphragm 76 is moved in opposition to the force of the spring 94 upward in the drawing integrally with the diaphragms 74 and 78 to reduce the degree of opening of the control valve 100 to the port 84 to reduce the amount of atmospheric air admitted into the passage 82 and therefore the degree of diluting the suction vacuum conducted into the chamber 46. As a result, the vacuum in the chamber 46 is increased to increase the degree of opening of the EGR control valve 38. Accordingly, since the pressure Pe in the chamber 28 is reduced to increase the difference between the pressure in the upstream port 30 and the pressure Pe, the amount of recirculated exhaust gases or the EGR amount is increased.

Conversely, when the venturi vacuum Pv is reduced due to decrease in the flow of air drawn into the engine, the diaphragm 76 is moved downward in the drawing to increase the degree of opening of the control valve 100 to the port 84 to increase the amount of atmospheric air admitted into the passage 82. As a result, since the dilution of the vacuum in the chamber 46 by atmospheric air is increased to reduce the degree of opening of the EGR control valve 38 to increase the pressure Pe in the chamber 28, the difference between the pressures in the upstream part 30 and the chamber 28 is reduced to reduce the EGR amount. Thus, in the EGR control system 10, the EGR amount is increased and reduced by reducing and increasing the pressure Pe in the chamber 28 in accordance with increase and decrease in the amount of air taken into the engine, respectively.

On the other hand, even if the pressure (exhaust gas pressure) in the upstream part 30 and therefore the vanturi vacuum Pv are not varied and therefore the degree of opening of the EGR control valve 38 is not varied, the pressure Pe in the chamber 28 is varied when the pressure in the downstream part 32 is varied due to variation in the engine suction vacuum. Such a change in the pressure Pe is corrected or eliminated by performing the feedback of the pressure Pe to the vacuum signal adjusting device 62 in the following manner.

When the pressure Pe in the chamber 28 and therefore the pressure in the chamber 72 of the device 62 are increased above a predetermined value, the diaphragm 78 is moved upward integrally with the diaphragms 74 and 76 to reduce the degree of opening of the control valve 100 to the port 84. As a result, since the working vacuum in the chamber 46 is increased to increase the degree of opening of the EGR control valve 38, the pressure Pe in the chamber 28 is reduced or returned to a former value.

Conversely, when the pressure Pe in the chamber 28 is reduced below a predetermined value, the diaphragm 78 is moved downward together with the diaphragms 74 and 76 to reduce the working vacuum in the chamber 46. As a result, the degree of opening of the EGR control valve 38 is reduced to increase or return the pressure Pe to a former value.

The relief valve means 116 functions to reduce the EGR amount at an operating condition of the engine in the following manner.

When the vacuum in the chamber 112 is increased above a predetermined value by an increase in the suction vacuum in the intake passageway 14 and a decrease in the amount of atmospheric air admitted from the chamber 66 into the passage 82, the diaphragm 110 is moved or attracted by the increased vacuum away from the open end 104 of the passage 102 in opposition to the force of the spring 114 to open the open end 104 to the atmosphere. As a result, since atmospheric air is admitted into the passage 102 to dilute or reduce the venturi vacuum Pv fed into the chamber 68, the diaphragms 74, 76 and 78 are moved downward to reduce the working vacuum in the chamber 46. Accordingly, since the degree of opening of the EGR control valve 38 is reduced, the EGR amount is reduced.

As an operating range of the engine in which the open end 104 of the passage 102 is opened by the relief valve or the diaphragm 110, there is considered a high speed and low load operating range in which the engine is running at a low load which causes an increase in the suction vacuum and at a high speed which causes an increase in the venturi vacuum Pv.

Since in this manner the EGR control system 10 is set to provide an EGR amount which is proper or optimum for the operation of the engine at a relatively low altitude at which the atmospheric pressure is about 1 atmosphere, the EGR control system 10 is operated to feed an excessively increased amount of exhaust gases to the intake passageway 14 at a relatively high altitude at which the density of air drawn into the engine is reduced, that is, the EGR control system 10 is operated to excessively increase the EGR amount in accordance with an increase in the altitude, unless the altitude correction means 116 is provided.

The altitude correction means 116 functions to automatically have the EGR control system 10 maintain the EGR amount at a proper value at all times independently of the density of air drawn into the engine in the following manner.

When the altitude is increased, since the atmospheric pressure is reduced, the bellows 128 of the altitude correction means 116 is prolonged leftwards in the drawing by expansion of air or other gas confined in the chamber 134 and by the force of the spring 138 located in the chamber 134. As a result, since the distance between the diaphragm 124 and the end wall portion 140 of the bellows 128 is increased to reduce the force of the spring 138 urging the diaphragm 124 against the passage 118, the diaphragm 124 is moved by the force of the spring 136 leftwards in the drawing. Accordingly, since the relief valve or the diaphragm 124 opens the open end 120 of the passage 118 to admit atmospheric air into the passage 118 to dilute or reduce the working vacuum in the chamber 46, the degree of opening of the EGR control valve 38 is reduced so that the EGR amount is reduced. Thus, the EGR amount is prevented from being excessively or undesirably increased due to a decrease in the density of air taken into the engine.

Figure 2:
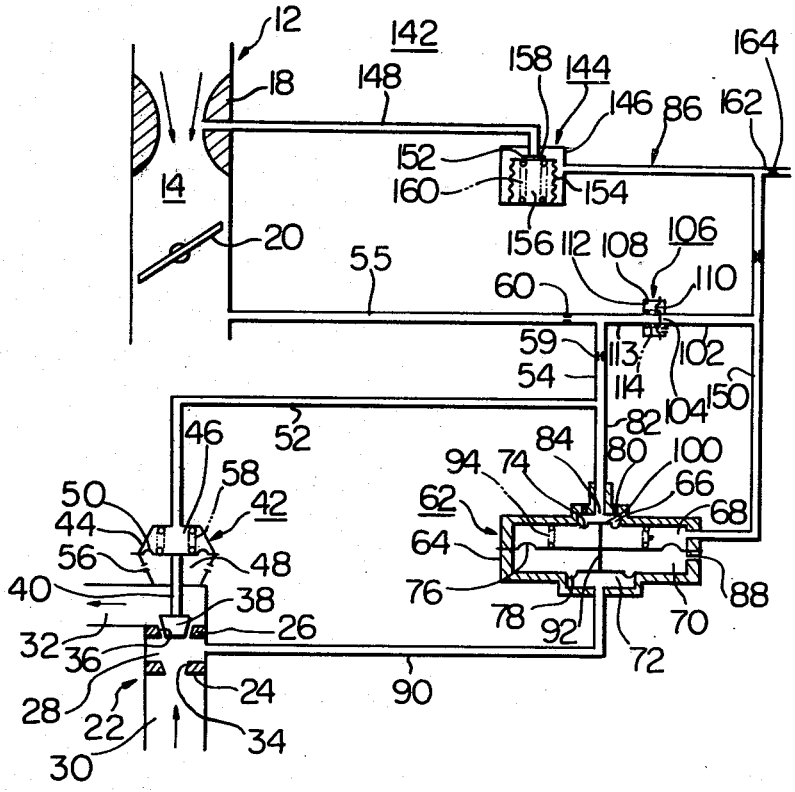
FIG. 2 is a schematic view of a second preferred embodiment of an EGR control system according to the invention.

Referring to FIG. 2 of the drawings, there is shown a second preferred embodiment of an EGR control system according to the invention. In FIG. 2, the same component elements as those of the EGR control system 10 shown in FIG. 1 are designated by the same reference numerals as those used in FIG. 1 and with respect to FIG. 2, the description as to the same component elements is omitted for purpose of brevity. The EGR control system, generally designated by the reference numeral 142, is characterized in that an altitude correction device 144 is located in the passage 86 which conducts the venturi vacuum Pv into the chamber 68. The altitude correction device 144 comprises a housing 146 located in the passage 86 to divide same into upstream and downstream sections 148 and 150 which both are connected to the housing 146 and have open ends opening into the housing 146. A flexible diaphragm 152 is located in the housing 146 movably relative to the open end, for example, of the upstream section 148. A bellows 154 is located in the housing 146 and is fixedly secured at one end portion to the housing 146 and is operatively connected at the other end portion to the diaphragm 152.00. The interior of the bellows 154 is hermetically sealed from the exterior thereof to form an air tight chamber 156. The air tight chamber 156 is filled with air which is admitted thereinto on a land having a relatively low altitude at which the atmospheric pressure is, for example, about 1 atmosphere. Alternatively, the air tight chamber 156 may be filled with another gas which serves similarly to the air in lieu thereof. The diaphragm 152 serves as a valve for opening and closing the open end of the upstream section 148 or for varying the degree of communication between the upstream and downstream sections 148 and 150 or the diaphragm 152 has such a valve 158 fixedly secured thereto. A spring 160 is provided to urge the diaphragm 152 toward the open end of the upstream section 148. The downstream section 150 communicates with the atmosphere through a passage or conduit 162 and an orifice 164 formed therein.

The EGR control system 142 thus described is operated in the following manner.

When the engine is running on a land having a relatively low altitude at which the atmospheric pressure is, for example, nearly 1 atmosphere, the bellows 154 is contracted by the relatively high atmospheric pressure to reduce the volume of the air tight chamber 156 into a position in which the diaphragm 152 or the valve 158 is spaced from the open end of the upstream section 148 to provide a complete communication between the upstream and downstream sections 148 and 150. As a result, the venturi vacuum Pv is completely conducted into the chamber 68 and the EGR control system 142 is operated similarly to the EGR control system 10 shown in FIG. 1 which is in a condition in which the open end 120 of the passage 118 is closed by the altitude correction valve means 122. Although atmospheric air is fed into the passage 86, since the amount of the air fed is limited by the orifice 164 and therefore is scanty, decrease in the venturi vacuunm Pv by the atpospheric air is small and can be neglected.

When the Engine is running on a land having a relatively high altitude at which the atmospheric pressure is reduced below 1 atmosphere, the bellows 154 expands owing to the reduced atmospheric pressure fed into the housing 146 through the passage 162 and the orifice 164 and acting on the external surfaces of the diaphragm 152 and the bellows 154. As a result, the volume of the air tight chamber 156 is increased to move the diaphragm 152 into a position in which the diaphragm 152 or the valve 158 closes the open end of the upstream section 148 or reduces the degree of communication between the upstream and downstream sections 148 and 150. This increases the influence of atmospheric air fed through the passage 162 and the orifice 164 on the venturi vacuum Pv to cause dilution of same by the atmospheric air. As a result, the degree of opening of the EGR control valve 38 is reduced to reduce the EGR amount.

In the case of this embodiment, since the venturi vacuum Pv acts on the external surfaces of the diaphragm 152 and the bellows 154, when the venturi vacuum Pv is exessively increased even when the engine is running on a land having a relatively low altitude at which the atmospheric pressure is almost 1 atmosphere, the bellows 154 expands to reduce the degree of communication between the upstream and downstream sections 148 and 150 to reduce the EGR amount. Accordingly, the EGR control system 142 has also a function or effect of reducing the EGR amount when the engine is in a high speed and high load operating condition in which the venturi vacuum Pv is excessively increased. This is to ensure the output of the engine.

Figure 3:
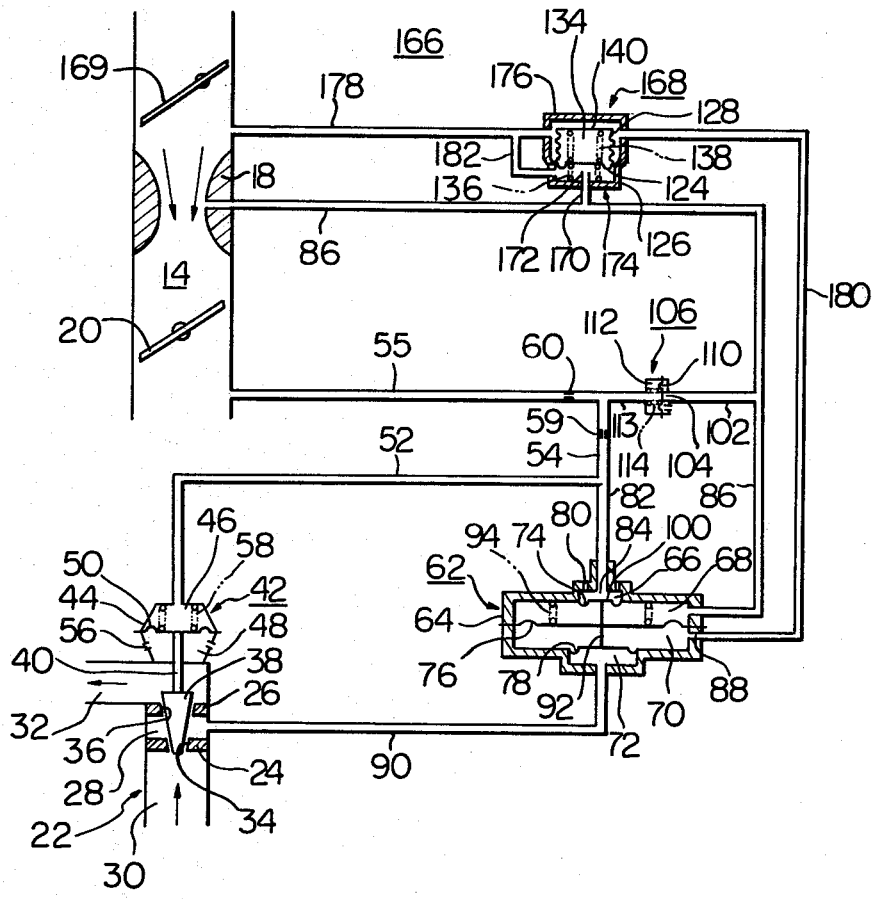
FIG. 3 is a schematic view of a third preferred embodiment of an EGR control system according to the invention.

Referring to FIG. 3 of the drawings, there is shown a third preferred embodiment. In FIG. 3, the same component elements as those of the EGR control system 10 shown in FIG. 1 are designated by the same reference numerals as those used in FIG. 1 and with respect to FIG. 3, the description as to the same component elements is omitted for purpose of brevity. The EGR control system, generally designated by the reference numeral 166, is characterized in that an altitude correction device 168 is provided to control communication between the passage 86 and the intake passageway 14 at a location upstream of the venturi 18 and the bellows 128 expands and contracts in response to the pressure in the intake passageway at the above-mentioned location. A choke valve 169 is rotatably mounted in the intake passageway 14 upstream of the venturi 18.

The altitude correction device 168 comprises a passage or conduit 170 branched off from the passage 86 upstream of the passage 102 and having an open end 172 located in a housing 126, and altitude correction valve means 174 for opening and closing the open end 172 which is similar to the altitude correction valve means 122 described with respect to and shown in FIG. 1. The altitude correction valve means 174 has a housing 176 fixedly connected to the housing 126 and enclosing the bellows 128 and spaced from the bellows 128, and a flexible diaphragm 124 fixed to the housings 126 and 176 and serving as or having a value which opens and closes the open end 172. The bellows 128 is fixed at one end portion to the diaphragm 124 and the housing 176 stationarily relative to the open end 172 and is arranged at the other end portion 140 movably relative to the open end 172. The diaphragm 124 defines in the bellows 128 together therewith a chamber 134 which is filled with a gas. A spring 136 urges the diaphragm 124 away from the open end 172, while a spring 138 urges the diaphragm 124 and the end portion 140 of the bellows 128 away from each other. The interior of the housing 176 communicates with the intake passageway 14 at a location upstream of the venturi 18 and downstream of the choke valve 169 through a passage or conduit 178 so that the pressure Pc in the intake passageway 14 between the venturi 18 and the choke valve 169 acts on the external surface of the bellows 128. The interior of the housing 176 also communicates with the chamber 70 of the vacuum signal adjusting device 62 through a passage or conduit 180 and the opening 88. The interior of the housing 126 communicates with the passage 178 through a passage or conduit 182.

The EGR control system 166 thus described is operated in the following manner.

When the engine is in a normal operating condition in which the degree of opening of the choke valve 169 is relatively great, the pressure Pc in the intake passageway 14 is increased to nearly the atmospheric pressure. Accordingly, when the engine is running on a land having a relatively low altitude as mentioned above, since the altitude correction valve means 174 closes the open end 172 of the passage 170 similarly to the altitude correction valve means 122, the EGR control system 166 is operated similarly to the EGR control system 10 described with respect of FIG. 1 which is in a condition in which the open end 120 of the passage 118 is closed by the altitude correction valve means 122.

When the engine is running on a land having a relatively high altitude as mentioned above, since the bellows 128 is expanded to weaken the force of the spring 138, the diaphragm 124 is moved away from the open end 172 of the passage 170 by the force of the spring 136 so that the open end 172 is opened. Accordingly, since the venturi vacuum Pv fed into the chamber 68 is diluted by atmospheric air admitted into the passage 86 to reduce the degree of opening of the EGR control valve 38, the EGR amount is reduced.

On the other hand, when the engine is running in a condition in which the choke valve 169 is closed as when the engine is started in a cold condition, since the pressure Pc is reduced to a vacuum and the vacuum is increased, the diaphragm 76 is moved downward in the drawing in response to the increased vacuum fed into the chamber 70 through the passages 178 and 180. As a result, the EGR amount is reduced to increase the operational performance of the engine at starting thereof when cold.

In each of the EGR control systems 10 and 142 shown respectively in FIGS. 1 and 2, the EGR control valve 38 is constructed and arranged in such a manner that the EGR amount is controlled by varying only the difference between the pressure in the upstream section 30 and the pressure in the chamber 28. On the other hand, in the EGR control system 166 shown in FIG. 3, the EGR control valve 38 is prolonged from the aperture 36 of the partition member 26 into the orifice 34 of the partition member 24. This is to control the EGR amount by varying the effective cross sectional area of the orifice 34 as well as the pressure differential of the upstream section 30 and the chamber 28. As a result, the degree of freedom to the control of the EGR amount is increased.

In each of the EGR control systems 10, 142 and 166, the orifice 34 can be dispensed with by properly selecting the flow resistance in the upstream section 30.

Although the invention has been described to be applied to, as an example, an EGR control system constructed and arranged such that the pressure in the EGR passageway at a location downstream of an orifice and upstream of the EGR control valve is reduced in accordance with increase in the venturi vacuum in the engine intake passageway, it can be applied to all EGR control systems of types other than the EGR control system of the type described above.

It will be thus appreciated that the invention provides an EGR control system which is capable of recirculating engine exhaust gases into engine taken air at a ratio optimum to the amount of engine taken air independent of the atmospheric pressure by reducing the EGR amount in accordance with decrease in the atmospheric pressure due to increase in the altitude so that the stability and ability of operation of the engine are increased.

What is claimed is:

1. An exhaust gas recirculation (EGR) control system in combination with an intake combustion engine including an intake passageway 14 providing communication between the atmosphere and the engine and having a venturi 18 formed therein; and an exhaust gas passageway providing communication between the engine and the atmosphere, said EGR control system 10, 142, 166 comprising an EGR passageway 22 providing communication between the exhaust gas passageway and the intake passageway for recirculating thereinto exhaust gas emitted from the engine, said EGR passageway having provided therein a restriction 24, 34 for restricting said EGR passageway;

an EGR control valve 38 which is disposed in said EGR passageway downstream of said restriction to define a first chamber 28 interposed between said restriction and said EGR control valve and is operable in opposite directions to increase and reduce the pressure of engine exhaust gas in said first chamber for controlling the flow of recirculated engine exhaust gas; and an operating device 42, 62 for operating said EGR control valve in said opposite directions in accordance with a working pressure, a pressure adjusting device 62 for adjusting said working pressure in accordance with said exhaust gas pressure in said first chamber and a vacuum in the venturi, and an altitude correction device 116, 144, 168 for adjusting said working pressure in accordance with the atmospheric pressure.

2. An exhaust gas recirculation control system for an internal combustion engine, comprising an EGR passageway 22 for providing communication between an exhaust gas passageway 16 of an internal combustion engine and an intake passageway 14 thereof for recirculating thereinto exhaust gases of the engine, an EGR control valve 38 disposed in said EGR passageway for controlling the flow of recirculated engine exhaust gases, operating means 42 for operating said EGR control valve in accordance with a working pressure, and altitude correction means 116, 144, 168 for adjusting said working pressure in accordance with the atmospheric pressure so that the flow of recirculated engine exhaust gases is reduced in accordance with decrease in the atmospheric pressure in which said EGR passageway is formed therein at a location upstream of said EGR control valve with a restriction, said EGR control valve and said restriction defining therebetween a first chamber, said operating means including a first flexible diaphragm having on a side thereof a second chamber adapted to communicate with the intake passageway downstream of a throttle valve rotatably mounted therein for receiving a suction vacuum serving as said working pressure, said first diaphragm being operatively connected to said EGR control valve for operating same so that the engine exhaust gas pressure in said first chamber is increased and reduced in accordance with decrease and increase in the vacuum in said second chamber, respectively, said system further comprising a vacuum signal adjusting device comprising first passage means communicating with said second chamber and having an open end providing communication between said first passage means and the atmosphere, a second control valve located movably relative to said open end for controlling the amount of atmospheric air admitted into said first passage means for diluting the vacuum in said second chamber, a third chamber adapted to communicate with a venturi formed in the intake passageway for receiving a venturi vacuum, a fourth chamber communicating with the atmosphere, a fifth chamber communicating with said first chamber, a second flexible diaphragm isolating said third chamber from the atmosphere, a third flexible diaphragm isolating said third and fourth chambers from each other, and a fourth flexible diaphragm isolating said fourth and fifth chambers from each other, said third diaphragm being operatively connected to said second control valve for operating same so that the amount of atmospheric air admitted into said first passage means is increased and reduced respectively in accordance with decrease and increase in the vacuum in said third chamber, said fourth diaphragm being operatively connected to said second control valve for operating same so that the amount of atmospheric air admitted into said first passage means is increased and reduced respectively in accordance with decrease and increase in the exhaust gas pressure in said fifth chamber.

3. An exhaust gas recirculation control system as claimed in claim 2, in which said altitude correction means comprises a bellows 128,154 the interior of which is hermetically sealed from the exterior thereof and which is filled therein with gas and the length of which is lengthened and shortened in response to decrease and increase in the atmospheric pressure, respectively;

second passage means providing communication between said second chamber and the atmosphere, a third control valve located movably relative to said second passage means for opening and closing same, said bellows being operatively connected to said third control valve for, in response to a first atmospheric pressure at a relatively low altitude causing said third control valve to close said second passage means and for, in response to a second atmospheric pressure at a relatively high altitude, causing said third control valve to open said second passage means.

4. An exhaust gas recirculation control system as claimed in claim 3, in which said bellows is located at one end portion stationarily and at the other end portion movably relative to said second passage means, said altitude corrrection means further comprising a flexible diaphragm which is connected to said one end portion of said bellows and which is responsive to the pressure of said gas in said bellows and which has said third control valve, a first spring urging said third control valve away from said second passage means, and a second spring located in said bellows for urging said third control valve and the other end portion of said bellows away from each other.

5. An exhaust gas recirculation control system as claimed in claim 2, in which said altitude correction means comprises a bellows 128,154 the interior of which is hermetically sealed from the exterior thereof and which is filled therein with gas and the length of which is lengthened and shortened in response to decrease and increase in the atmospheric pressure, respectively, a housing the interior of which is adapted to communicate with a portion of the intake passageway located upstream of the venturi and downstream of a choke valve and communicates with said fourth chamber, second passage means opening into said housing and adapted to communicate with the venturi and communicating with said third chamber, and a third control valve movably located in said housing for opening and closing said second passage means, said bellows being located in said housing and being operatively connected to said third control valve for, in response to a first pressure in said portion of the intake passageway at a relatively low altitude, causing said third control valve to close said second passage means and for, in response to a second pressure in said portion at a relatively high altitude causing said third control valve to open said second passage means.

6. An exhaust gas recirculation control system as claimed in claim 5, in which said bellows is fixedly secured at one end portion to said housing stationarily relative to said second passage means and is located at the other end portions movably relative to said second passage means, said altitude correction means further comprising a flexible diaphragm is connected to said one end portion of said bellows and which is responsive to the pressure of said gas in said bellows and has said third control valve, a first spring urging said third control valve away from said second passage means, and a second spring located in said bellows for urging said third control valve and the other end portion of said bellows away from each other.

7. An exhaust gas recirculation control system as claimed in claim 2, in which said altitude correction means comprises a bellows the interior of which is hermetically sealed from the exterior thereof and which is filled therein with gas and the length of which is lengthened and shortened in response to decrease and increase in the atmospheric pressure, respectively, second passage means providing communication between said second chamber and the atmosphere, a third control valve located movably relative to said second passage means for opening and closing same, said bellows being operatively connected to said third control valve, said bellows being located at one end portion stationarily and at the other end portion movably relative to said second passage means, said altitude correction means further comprising a flexible diaphragm which is connected to said one end portion of said bellows and which has said third control valve and which receives the pressure of said gas in said bellows, a first spring urging said third control valve away from said second passage means, and a second spring located in said bellows and providing connection between said third control valve and the other end portion of said bellows for urging said third control valve and said other end portion away from each other so that said bellows causes said third control valve to close said second passage means in response to a first atmospheric pressure of the intake passageway at a relatively low altitude and to open said second passage means in response to a second atmospheric pressure at a relatively high altitude.

8. An exhaust gas recirculation control system as claimed in claim 2, in which said altitude correction means comprises a housing, second passage means adapted to communicate with the venturi and opening into said housing, third passage means opening into said housing and communicating with said third chamber and with the atmosphere, a third control valve movably located in said housing to control communication between said second and third passage means, and a bellows the interior of which is hermetically sealed from the exterior thereof and which is filled therein with gas and the length of which is lengthened and shortened in response to decrease and increase in atmospheric pressure, respectively, said bellows being located in said housing and being fixedly secured at one end portion thereof to said housing, said bellows being operatively connected at the other end portion thereof to said third control valve for, in response to a first atmospheric pressure at a relatively low altitude, operating said third control valve to increase communication between said second and third passage means and for, in response to a second atmospheric pressure at a relatively high altitude, operating said third control valve to reduce communication between said second and third passage means.

9. An exhaust gas recirculation control system as claimed in claim 2, in which said altitude correction means comprises a housing the interior of which is adapted to communicate with a portion of the intake passageway located upstream of the venturi and downstream of a choke valve and communicates with said fourth chamber, second passage means opening into said housing and adapted to communicate with the venturi and communicating with said third chamber, a third control valve movably located in said housing for opening and closing said second passage means, a bellows the interior of which is hermetically seated from the exterior thereof and which is filled therein with gas and the length of which is lengthened and shortened in response to decrease and increase in the atmospheric pressure, respectively, said bellows being located in said housing and operatively connected to said third control valve, said bellows being located at one end portion stationarily and at the other end portion movably relative to said second passage means, said altitude correction means further comprising a flexible diaphragm which is connected said one end portion of said bellows and which has said third control valve and which receives the pressure of said gas in said bellows a first spring urging said third control valve away from said second passage means, and a second spring located in said bellows and providing connection between said third control valve and the other end portion of said bellows for urging said third control valve and said other end portion away from each other so that said bellows causes said third control valve to close said second passage means in response to a first pressure in said portion of the intake passageway at a relatively low altitude and to open said passage means in response to a second pressure in said portion of the intake passageway at relatively high attitude.

* * * * *